US012018900B2

(12) United States Patent
Mu et al.

(10) Patent No.: US 12,018,900 B2
(45) Date of Patent: Jun. 25, 2024

(54) SYSTEMS AND METHODS FOR HEAT EXCHANGE

(71) Applicant: Rheem Manufacturing Company, Atlanta, GA (US)

(72) Inventors: Baojie Mu, Aubrey, TX (US); Sivakumar Gopalnarayanan, Plano, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 293 days.

(21) Appl. No.: 17/194,387

(22) Filed: Mar. 8, 2021

(65) Prior Publication Data

US 2022/0282937 A1 Sep. 8, 2022

(51) Int. Cl.

| | |
|---|---|
| ***F28F 3/08*** | (2006.01) |
| ***F28F 1/12*** | (2006.01) |
| ***F28F 3/02*** | (2006.01) |

(52) U.S. Cl.

CPC ..... *F28F 3/08* (2013.01); *F28F 1/126* (2013.01); *F28F 3/025* (2013.01); *F28F 2210/10* (2013.01); *F28F 2260/02* (2013.01)

(58) Field of Classification Search

CPC .... F28F 3/08; F28F 1/126; F28F 3/025; F28F 2210/10; F28F 2260/02

USPC ..... 165/166

See application file for complete search history.

(56) References Cited

U.S. PATENT DOCUMENTS

| | | | | |
|---|---|---|---|---|
| 6,386,277 | B1 * | 5/2002 | Wattelet | F28D 7/0008 165/175 |
| 6,827,139 | B2 * | 12/2004 | Kawakubo | F28F 9/0243 165/173 |
| 6,991,026 | B2 * | 1/2006 | Costen | F28F 3/025 60/39.511 |
| 7,108,049 | B2 * | 9/2006 | Makino | F28F 1/128 165/149 |

(Continued)

FOREIGN PATENT DOCUMENTS

CN 111 322 795 A 6/2020

OTHER PUBLICATIONS

International Search Report and Written Opinion for PCT/US2022/019089, dated Jun. 8, 2022 (14 pp.).

(Continued)

*Primary Examiner* — Claire E Rojohn, III

(74) *Attorney, Agent, or Firm* — Eversheds Sutherland (US) LLP

(57) ABSTRACT

An interlaced heat exchanger is described. The interlaced heat exchanger includes a plurality of microchannel tubes configured to allow flow of a first fluid therethrough and a plurality of flat tubes configured to allow flow of a second fluid therethrough to exchange heat with the first fluid. The plurality of microchannel tubes and the plurality of flat tubes are stacked in an alternating arrangement along a longitudinal axis of the interlaced heat exchanger such that the plurality of microchannel tubes and the plurality of flat tubes are interlaced. The interlaced heat exchanger further includes a plurality of fin plates interspersed with the plurality of microchannel tubes and the plurality of flat tubes. The plurality of fin plates allows a flow of air across a width of the interlaced heat exchanger to exchange heat with at least one of the first fluid and the second fluid.

16 Claims, 6 Drawing Sheets

(56) References Cited

U.S. PATENT DOCUMENTS

| | | | | |
|---|---|---|---|---|
| 7,398,643 | B2 * | 7/2008 | Cotton | F28D 9/0043 60/275 |
| 7,621,320 | B2 * | 11/2009 | Muto | F28D 7/0008 165/177 |
| 7,640,970 | B2 * | 1/2010 | Kim | F28F 17/005 62/526 |
| 8,272,233 | B2 * | 9/2012 | Yoshimura | F25B 40/00 62/515 |
| 9,448,013 | B2 * | 9/2016 | Ito | F28F 3/046 |
| 9,651,317 | B2 * | 5/2017 | Jindou | F28F 9/02 |
| 11,614,285 | B2 * | 3/2023 | Huang | F28D 1/0417 165/183 |
| 2011/0056667 | A1 | 3/2011 | Taras et al. | |
| 2018/0299171 | A1 | 10/2018 | Olsen et al. | |
| 2019/0368817 | A1 | 12/2019 | Huang et al. | |
| 2020/0326140 | A1 * | 10/2020 | Fuller | F28D 1/0452 |

OTHER PUBLICATIONS

Alghamdi et al., "Water-Based Thermal Energy Storage for Heating and Air-Conditioning Applications in Residential Buildings: Review and Preliminary Study," Jul. 10-14, 2022, 19th International Refrigeration and Air Conditioning Conference at Purdue, Paper 2345, 11 pages.

Alghamdi et al., "Modeling, Simulating, and Validating a Novel Three-Fluid Heat Exchanger (TriCoil) for a Residential Heating and Air-Conditioning System Integrating Water-Based Thermal Energy Storage," May 16, 2023, Energy and Buildings, 30 pages.

Alghamdi et al., "Modeling, Simulating, and Validating a Novel Three-Fluid Heat Exchanger (TriCoil) for a Residential Heating and Air-Conditioning System Integrating Water-Based Thermal Energy Storage," Nov. 1, 2023, ScienceDirect, Energy and Buildings, vol. 298, 7 pages.

* cited by examiner

SYSTEMS AND METHODS FOR HEAT EXCHANGE

TECHNICAL FIELD

The present disclosure generally relates to systems and methods for heat exchange. In particular, the systems and methods relate to heat exchange between two or more fluids.

BACKGROUND

A heat exchanger is a system used to transfer heat between two fluids. Heat exchangers are used in both cooling and heating processes. For example, the heat exchangers are used in space heating, refrigeration, air conditioning, power stations, chemical plants, petrochemical plants, petroleum refineries, natural-gas processing, and sewage treatment. Existing heat exchangers involve two-fluid heat exchange.

SUMMARY

According to an aspect of the present disclosure, an interlaced heat exchanger is disclosed. The interlaced heat exchanger includes a plurality of microchannel tubes configured to allow flow of a first fluid therethrough and a plurality of flat tubes configured to allow flow of a second fluid therethrough to exchange heat with the first fluid. The plurality of microchannel tubes and the plurality of flat tubes are stacked in an alternating arrangement along a longitudinal axis of the interlaced heat exchanger such that the plurality of microchannel tubes and the plurality of flat tubes are interlaced. The interlaced heat exchanger further includes a plurality of fin plates interspersed with the plurality of microchannel tubes and the plurality of flat tubes. The plurality of fin plates allows a flow of air across a width of the interlaced heat exchanger to exchange heat with at least one of the first fluid and the second fluid.

In an embodiment, the interlaced heat exchanger further includes a first inlet header and a first outlet header fluidly coupled to the plurality of microchannel tubes. The first inlet header is configured to supply the first fluid into the plurality of microchannel tubes, and the first outlet header is configured to receive the first fluid from the plurality of microchannel tubes. In an embodiment, the interlaced heat exchanger further includes a second inlet header and a second outlet header fluidly coupled to the plurality of flat tubes. The second inlet header is configured to supply the second fluid into the plurality of flat tubes, and the second outlet header is configured to receive the second fluid from the plurality of flat tubes.

In an embodiment, the first fluid flows through the plurality of microchannel tubes in a first direction, and the second fluid flows through the plurality of flat tubes in a second direction, and wherein the first direction is opposite to the second direction.

In an embodiment, the first fluid is a refrigerant. In an embodiment, the second fluid is one of water and a refrigerant.

In an embodiment, the plurality of fin plates is alternatively interspersed with the plurality of microchannel tubes and the plurality of flat tubes. In an embodiment, each fin plate of the plurality of fin plates extends along the width of the interlaced heat exchanger.

In an embodiment, the interlaced heat exchanger further includes a third inlet header and a third outlet header fluidly coupled to the plurality of microchannel tubes, where the third inlet header is configured to supply the first fluid into the plurality of microchannel tubes and the third outlet header is configured to receive the first fluid from the plurality of microchannel tubes. In an embodiment, the third inlet header is configured to supply the first fluid into the plurality of microchannel tubes in an alternating arrangement with respect to the first inlet header.

In an embodiment, the first inlet header is configured to supply the first fluid to a first subset of the plurality of microchannel tubes located in a first portion of the interlaced heat exchanger, and the third inlet header is configured to supply the first fluid to a second subset of the plurality of microchannel tubes located in a second portion of the interlaced heat exchanger.

In an embodiment, a predefined number of flat tubes of the plurality of flat tubes is sandwiched between rows of microchannel tubes of the plurality of microchannel tubes to define a first heat exchanging set, where the first heat exchanging set is sandwiched between two fin plates. In an embodiment, a predefined number of microchannel tubes of the plurality of microchannel tubes is sandwiched between two fin plates to define a second heat exchanging set, and where the second heat exchanging set is sandwiched between rows of flats tubes of the plurality of flat tubes. In an embodiment, a predefined number of microchannel tubes of the plurality of microchannel tubes is sandwiched between rows of flat tubes of the plurality of flat tubes to define a third heat exchanging set, and where the third heat exchanging set is sandwiched between two fin plates.

According to another aspect of the present disclosure, an interlaced heat exchanger is disclosed. The interlaced heat exchanger includes a plurality of microchannel tubes configured to allow flow of a first fluid therethrough and a plurality of flat tubes configured to allow flow of a second fluid therethrough to exchange heat with the first fluid, where the plurality of microchannel tubes and the plurality of flat tubes are stacked in an alternating arrangement along a longitudinal axis of the interlaced heat exchanger such that the plurality of microchannel tubes and the plurality of flat tubes are interlaced.

In an embodiment, a number of flat tubes of the plurality of flat tubes is less than the number of microchannels defined in each microchannel tube of the plurality of microchannel tubes.

According to another aspect of the present disclosure, a method of exchanging heat between two or more fluids in an interlaced heat exchanger is disclosed. The method includes allowing a first fluid to flow through a plurality of microchannel tubes in a first direction along a width of the interlaced heat exchanger. The method further includes allowing a second fluid to flow through a plurality of flat tubes in a second direction along the width of the interlaced heat exchanger to allow heat exchange between the first fluid and the second fluid, where the plurality of microchannel tubes and the plurality of flat tubes are stacked in an alternating arrangement along a longitudinal axis of the interlaced heat exchanger such that the plurality of microchannel tubes and the plurality of flat tubes are interlaced. The method also includes allowing a third fluid to flow through a plurality of fin plates interspersed with the plurality of microchannel tubes and the plurality of flat tubes, where the third fluid flows in a direction across the width of the interlaced heat exchanger to exchange heat with at least one of the first fluid and the second fluid.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
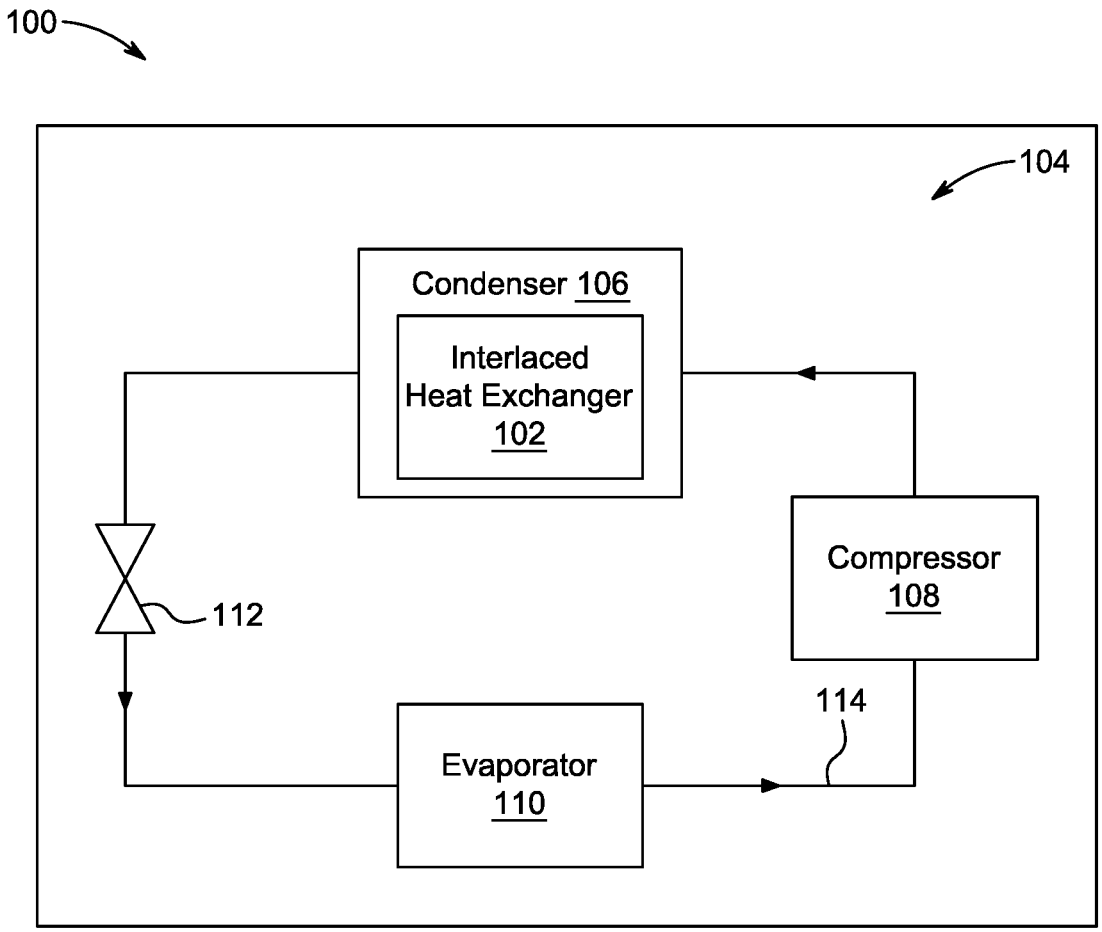
FIG. 1 is a schematic block diagram of a refrigeration device including an interlaced heat exchanger, according to an embodiment of the present disclosure.

Referring to FIG. 1, a schematic diagram of a refrigeration device 100 including an interlaced heat exchanger 102 is illustrated. The refrigeration device 100 includes a circuit 104. The circuit 104 includes a condenser 106, a compressor 108, an evaporator 110, an expansion valve 112 orderly connected by a refrigerant flow path 114. Further, the condenser 106 includes the interlaced heat exchanger 102. However, it will be apparent to a person skilled in the art that, in some embodiments, the interlaced heat exchanger 102 may be implemented in the evaporator 110. In some embodiments, the condenser 106 and the evaporator 110 may include the interlaced heat exchanger 102. General operational functions of the condenser 106, the compressor 108, the evaporator 110, and the expansion valve 112 are known in the art and thus will not be explained in detail for the sake of brevity. The interlaced heat exchanger 102 is explained in greater detail below.

Figure 2:
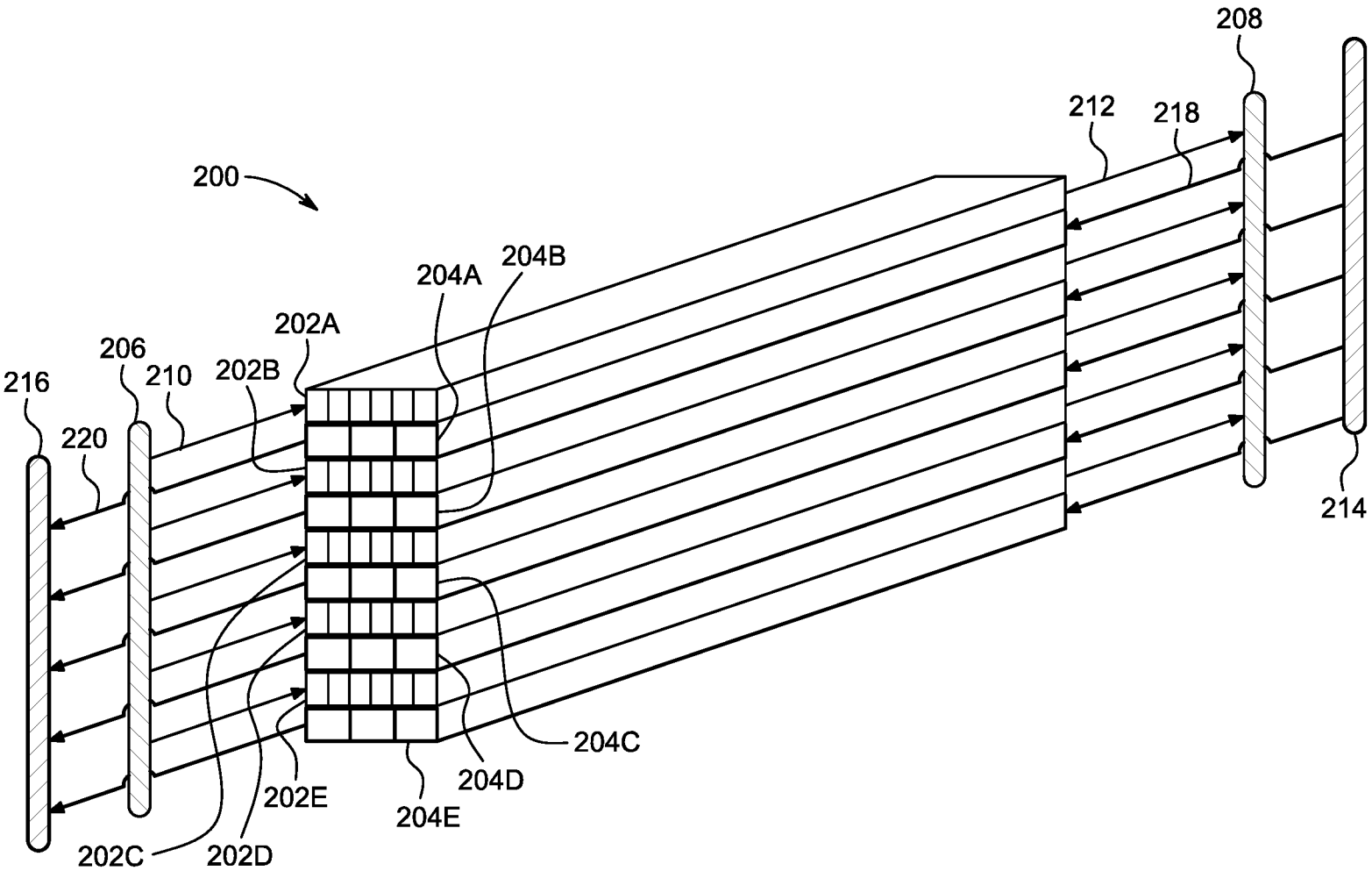
FIG. 2 is a schematic diagram of the interlaced heat exchanger, according to an embodiment of the present disclosure.

FIG. 2 is a schematic diagram of the interlaced heat exchanger 200, according to an embodiment of the present disclosure. The interlaced heat exchanger 200 may correspond to the interlaced heat exchanger 102 of FIG. 1.

According to an embodiment, the interlaced heat exchanger 200 includes a plurality of microchannel tubes 202A-E and a plurality of flat tubes 204A-E. In an implementation, the plurality of microchannel tubes 202A-E may alternatively be referred to as a plurality of minichannel tubes 202A-E or a plurality of mini-channel tubes 202A-E. In an example, the size of each microchannel tube of the plurality of microchannel tubes 202A-E may be in a range of about 0.001 mm to about 2.0 mm.

As shown in FIG. 2, the plurality of microchannel tubes 202A-E and the plurality of flat tubes 204A-E have a rectangular cross-section. In some embodiments, the plurality of microchannel tubes 202A-E and the plurality of flat tubes 204A-E may have a circular cross-section, a square cross-section, or any other cross-section shape. In some embodiments, the plurality of microchannel tubes 202A-E and the plurality of flat tubes 204A-E may have same cross-section shapes or may have different cross-section shapes. In some embodiments, individual flat tubes of the plurality of flat tubes 204A-E may have a larger cross-sectional area than individual microchannel tubes of the plurality of the microchannel tubes 202A-E. In some embodiments, the plurality of flat tubes 204A-E may have a larger cross-sectional area than the plurality of the microchannel tubes 202A-E. Although the plurality of flat tubes 204A-E are illustrated in FIG. 2 and below, the flat tubes 204A-E can be in various configurations including non-flat or in textures or shapes.

In an embodiment, as can be seen in FIG. 2, the plurality of microchannel tubes 202A-E includes five microchannel tubes, namely, a first microchannel tube 202A, a second microchannel tube 202B, a third microchannel tube 202C, a fourth microchannel tube 202D, and a fifth microchannel tube 202E. Further, the plurality of flat tubes 204A-E includes five flat tubes, namely, a first flat tube 204A, a second flat tube 204B, a third flat tube 204C, a fourth flat tube 204D, and a fifth flat tube 204E. In other embodiments, the plurality of microchannel tubes 202A-E and the plurality of flat tubes 204A-E can include any number of microchannels tubes and flat tubes, respectively. In an implementation, the number of microchannel tubes and the number of flat tubes in the interlaced heat exchanger 102 may depend on the amount of the first fluid and the second fluid that is input into the interlaced heat exchanger 200.

According to an embodiment, the plurality of microchannel tubes 202A-E and the plurality of flat tubes 204A-E are stacked in an alternating arrangement along a longitudinal axis of the interlaced heat exchanger 200 such that the plurality of microchannel tubes 202A-E and the plurality of flat tubes 204A-E are interlaced. In an implementation, the plurality of microchannel tubes 202A-E and the plurality of flat tubes 204A-E are joined using a thin layer of braze material and are brazed together. Alternatively, the plurality of microchannel tubes 202A-E and the plurality of flat tubes 204A-E may be joined using other joining techniques that are contemplated herein. As used herein, the term "alternating arrangement" may include the first flat tube 204A of the plurality of flat tubes 204A-E arranged in between the first microchannel tube 202A and the second microchannel tube 202B of the plurality of microchannel tubes 202A-E, the second flat tube 204B of the plurality of flat tubes 204A-E arranged in between the second microchannel tube 202B and the third microchannel tube 202C of the plurality of microchannel tubes 202A-E, and so on. In other embodiments, the plurality of microchannel tubes 202A-E and the plurality of flat tubes 204A-E may be arranged in any suitable alternating arrangement.

In an embodiment, each microchannel tube of the plurality of microchannel tubes 202A-E may include one or more microchannels for the flow of the first fluid therein. Further, each flat tube of the plurality of flat tubes 204A-E may include one or more tubes for the flow of the second fluid therein. As illustrated in the exemplary FIG. 2, each microchannel tube of the plurality of microchannel tubes 202A-E includes six microchannels, and each flat tube of the plurality of flat tubes 204A-E includes three tubes. Although, it has been shown that each microchannel tube of the plurality of microchannel tubes 202A-E and each flat tube of the plurality of flat tubes 204A-E includes six microchannels and three tubes, respectively, in some embodiments, each microchannel tube and each flat tube may include any number of microchannels and tubes, respectively.

In an example, the plurality of flat tubes 204A-E adds to the structural strength of the interlaced heat exchanger 102. Also, a size of a tube may be larger than a size of a microchannel providing structural strength to the interlaced heat exchanger 200. In an implementation, each microchannel tube of the plurality of microchannel tubes 202A-E may have a similar configuration. For example, the number of microchannels defined in the first microchannel tube 202A may be equal to the number of microchannels defined in the second microchannel tube 202B. Alternatively, each microchannel tube of the plurality of microchannel tubes 202A-E may have a different configuration, i.e., a number of microchannels defined in the first microchannel tube 202A may be more than or less than the number of microchannels defined in the second microchannel tube 202B. Further, in an implementation, each flat tube of the plurality of flat tubes 204A-E may have a similar configuration. For example, a number of flat tubes defined in the first flat tube 204A may be equal to the number of flat tubes defined in the second flat tube 204B. Alternatively, each flat tube of the plurality of flat tubes 204A-E may have a different configuration. For example, a number of flat tubes defined in the first flat tube 204A may be more than or less than the number of flat tubes defined in the second flat tube 204B.

In an embodiment, a number and size of each of the microchannel tubes and the flat tubes may depend on a flow rate of the first fluid and the second fluid, respectively, and a design of the interlaced heat exchanger 200. In an embodiment, a number of flat tubes of the plurality of flat tubes 204A-E may be less than a number of microchannels defined in each microchannel tube of the plurality of microchannel tubes 202AE. In some embodiments, a number of tubes in each flat tube may also be less than a number of microchannels in each microchannel tube. In an example, the number of tubes in each flat tube may be half the number of microchannels in each microchannel tube. In another example, the number of tubes in each flat tube may be one fourth the number of microchannels in each microchannel tube.

In an implementation, the interlaced heat exchanger 200 further includes a first inlet header 206 and a first outlet header 208 fluidly coupled to the plurality of microchannel tubes 202A-E. The first inlet header 206 is configured to supply the first fluid into the plurality of microchannel tubes 202A-E, as indicated by arrow 210. Further, the first outlet header 208 is configured to receive the first fluid from the plurality of microchannel tubes 202A-E, as indicated by arrow 212. The interlaced heat exchanger 102 also includes a second inlet header 214 and a second outlet header 216 fluidly coupled to the plurality of flat tubes 204A-E. The second inlet header 214 is configured to supply the second fluid into the plurality of flat tubes 204A-E, as indicated by arrow 218. Further, the second outlet header 216 is configured to receive the second fluid from the plurality of flat tubes 204A-E, as indicated by arrow 220.

As shown in FIG. 2, the first inlet header 206 and the second outlet header 216 are positioned at a first end of the interlaced heat exchanger 200, and the first outlet header 208 and the second inlet header 214 are positioned at a second end of the interlaced heat exchanger 102 which is opposite to the first end. Also, the first inlet header 206 and the second outlet header 216 may be positioned adjacent to each other, and the first outlet header 208 and the second inlet header 214 may be positioned adjacent to each other. In some embodiments, positions of the first inlet header 206, the first outlet header 208, the second inlet header 214, and the second outlet header 216 may be interchanged. As such, the flow direction of the first fluid and the second fluid may be interchanged.

In operation, the plurality of microchannel tubes 202A-E is configured to allow flow of a first fluid therethrough, and the plurality of flat tubes 204A-E is configured to allow flow of a second fluid therethrough to exchange heat with the first fluid. In an example, the first fluid may be a refrigerant, and the second fluid may be water. In some examples, the second fluid may be any heat transfer fluid, such as another refrigerant. In an embodiment, the first fluid flows through the plurality of microchannel tubes 202A-E in a first direction, and the second fluid flows through the plurality of flat tubes 204A-E in a second direction. In some implementations, the first direction is opposite to the second direction. Accordingly, the first fluid and the second fluid flow parallel to each other but in opposite directions. As a result of interlaced structure, heat exchange between the first fluid and the second fluid takes place through the plurality of microchannel tubes 202A-E and the plurality of flat tubes 204A-E. In an implementation, the plurality of microchannel tubes 202A-E and the plurality of flat tubes 204A-E may be constructed using aluminum, copper or any other good conductive material that promotes heat exchange between the first fluid and the second fluid through the plurality of microchannel tubes 202A-E and the plurality of flat tubes 204A-E. According to an implementation, as the first fluid is supplied by the first inlet header 206, the first fluid flows into each microchannel tube of the plurality of microchannel tubes 202A-E. Further, as the second fluid is supplied by the second inlet header 214, the second fluid flows into each tube of each flat tube of the plurality of flat tubes 204A-E. According to an aspect of the present disclosure, a primary mode of heat exchange in the interlaced heat exchanger 200 provided in FIG. 2 is between the refrigerant and the water (or any heat transfer fluid) with refrigerant flow countercurrent to water flow.

Figure 3:
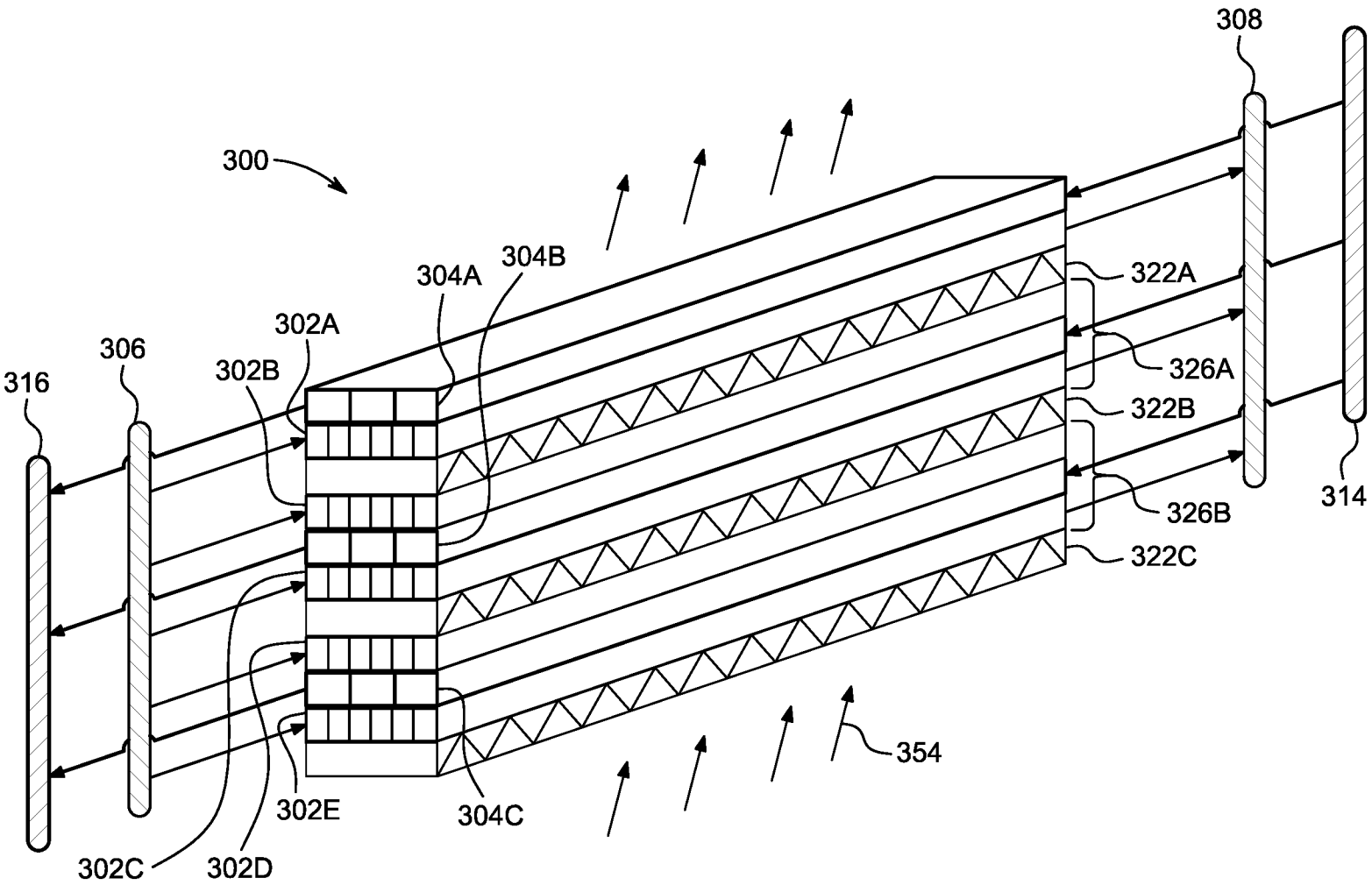
FIG. 3 is a schematic diagram of another interlaced heat exchanger, according to an embodiment of the present disclosure.

FIG. 3 is a schematic diagram of an interlaced heat exchanger 300, according to another embodiment of the present disclosure. The interlaced heat exchanger 300 may correspond to the interlaced heat exchanger 102 of FIG. 1.

According to an embodiment, the interlaced heat exchanger 300 includes the plurality of microchannel tubes 302A-E and the plurality of flat tubes 304A-C. The plurality of microchannel tubes 302A-E is configured to allow flow of the first fluid (for example, refrigerant) therethrough, and the plurality of flat tubes 304A-C is configured to allow flow of the second fluid (for example, water or any heat transfer fluid) therethrough to exchange heat with the first fluid. The flow of first fluid and the second fluid in FIG. 3 are similar to that of FIG. 2. As shown in FIG. 3, the interlaced heat exchanger 300 includes the first microchannel tube 302A, the second microchannel tube 302B, the third microchannel tube 302C, the fourth microchannel tube 302D, and the fifth microchannel tube 302E. Further, the interlaced heat exchanger 300 includes the first flat tube 304A, the second flat tube 304B, and the third flat tube 304C. In an implementation, the interlaced heat exchanger 300 further includes the first inlet header 306 and the first outlet header 308 fluidly coupled to the plurality of microchannel tubes 302A-E, and the second inlet header 314 and the second outlet header 316 fluidly coupled to the plurality of flat tubes 304A-C.

In an embodiment, the interlaced heat exchanger 300 includes a plurality of fin plates 322A-C interspersed with the plurality of microchannel tubes 302A-E and the plurality of flat tubes 304A-C. In an implementation, the plurality of fin plates 322A-C are alternatively interspersed with the plurality of microchannel tubes 302A-E and the plurality of flat tubes 304A-C. In an embodiment, as shown in FIG. 3, the plurality of fin plates 322A-C includes three fin plates, namely, a first fin plate 322A, a second fin plate 322B, and a third fin plate 322C. In other embodiments, the plurality of fin plates 322A-C can include any number of fin plates. The plurality of fin plates 322A-C allows flow of air (indicated by arrow 354) across a width of the interlaced heat exchanger 300 to exchange heat with at least one of the first fluid and the second fluid. Further, each of the plurality of fin plates 322A-C is embodied as a wave-shaped plate. Although it has been shown that each of the plurality of fin plates 322A-C have substantially the same sectional shape, in some embodiments, at least some (or, for example, all) of the plurality of fin plates 322A-C may have different cross-sectional shapes. In an implementation, the plurality of fin plates 322A-C may be disposed between and rigidly attached, by a braze process, to the plurality of microchannel tubes 302A-E and the plurality of flat tubes 304A-C, in order to enhance heat exchange and provide structural rigidity for the interlaced heat exchanger 300. According to an exemplary embodiment, the plurality of fin plates 322A-C may be manufactured from aluminum. However, according to other exemplary embodiments, the plurality of fin plates 322A-C may be made of other materials that facilitate heat exchange.

In an implementation, a predefined number of flat tubes of the plurality of flat tubes 304A-C is sandwiched between rows of microchannel tubes of the plurality of microchannel tubes 302A-E to define a first heat exchanging set 326A-B. Further, the first heat exchanging set 326A is sandwiched between two fin plates. As can be seen in FIG. 3 as an example, the second flat tube 304B is sandwiched between the second microchannel tube 302B and the third microchannel tube 302C to define the first heat exchanging set 326A. Further, the first heat exchanging set 326A is sandwiched between the first fin plate 322A and the second fin plate 322B. Similarly, the third flat tube 304C is sandwiched between the fourth microchannel tube 302D and the fifth microchannel tube 302E to define a first heat exchanging set 326B. Further, the first heat exchanging set 326B is sandwiched between the second fin plate 322B and the third fin plate 322C. Similarly, interlaced heat exchanger 300 may include multiple such heat exchanging sets. The arrangement of the plurality of flat tubes 304A-C, the plurality of microchannel tubes 302A-E, and the plurality of fin plates 322A-C illustrated in FIG. 3 should not be construed as limiting. Multiple configurations of the interlaced heat exchanger 300 will be apparent to the person skilled in the art from the FIG. 3 and the description hereinabove.

In an implementation, the interlaced heat exchanger 300 may be deployed in applications where the refrigerant exchanges heat with either water (or any heat transfer fluid) or with air separately or simultaneously. In an implementation, maximum heat transfer achieved between refrigerant and water, and refrigerant and air may be determined individually. Based on the determination, the flow of one of the two fluids, that is, air or water, may be controlled. For example, if maximum heat exchange occurs with water, the flow of air through the fin plates may be controlled or turned off. In another example, if maximum heat exchange occurs with air, the flow of water through the flat tubes may be controlled or turned off. Further, in an implementation, the interlaced heat exchanger 300 can be used as a refrigeration condenser where, at ambient conditions, the water as a coolant may be able to supplement heat rejection to air. Consequently, the required heat load may be achieved in a compact geometry. In another implementation, the interlaced heat exchanger 300 may be used as a refrigeration evaporator. Under ambient conditions, a refrigeration evaporator is subjected to frosting for various reasons. Thus, a defrosting operation may be performed on the refrigeration evaporator to ensure that the refrigeration evaporator operates efficiently. In an example, water circulation through the interlaced heat exchanger 300 may allow for quick defrosting without having to resort to other defrosting techniques, such as a hot gas defrosting technique and an electric defrosting technique.

Figure 4:
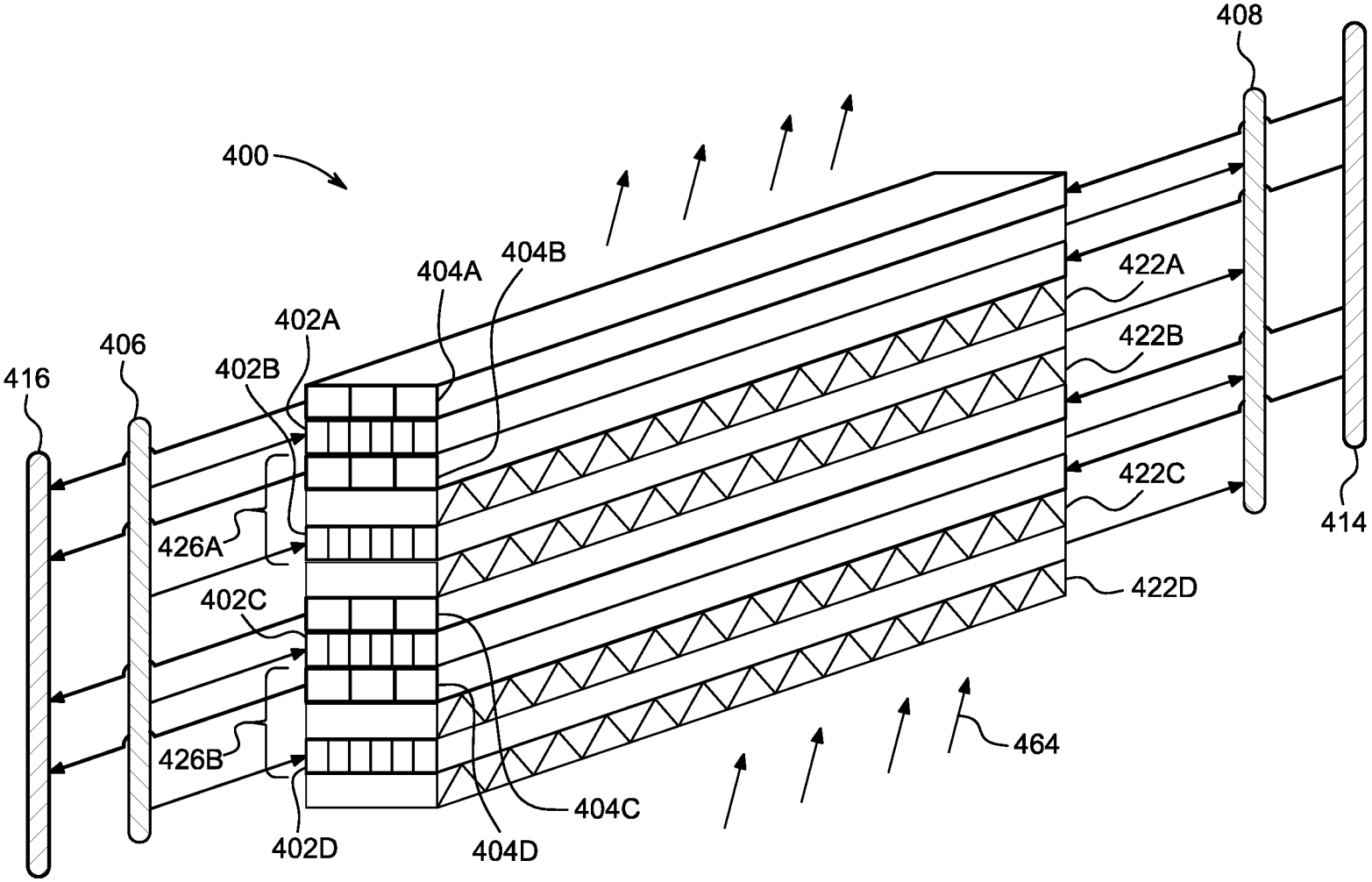
FIG. 4 is a schematic diagram of the interlaced heat exchanger, according to another embodiment of the present disclosure.

FIG. 4 is a schematic diagram of an interlaced heat exchanger 400, according to yet another embodiment of the present disclosure. The interlaced heat exchanger 400 may correspond to the interlaced heat exchanger 102 of FIG. 1.

According to an embodiment, the interlaced heat exchanger 400C includes the plurality of microchannel tubes 402A-D and the plurality of flat tubes 404A-D. The plurality of microchannel tubes 402A-D is configured to allow flow of the first fluid (for example, refrigerant) therethrough and the plurality of flat tubes 404A-D is configured to allow flow of the second fluid (for example, water or any heat transfer fluid) therethrough to exchange heat with the first fluid. The flow of first fluid and the second fluid of FIG. 4 are substantially similar to that of FIG. 2. As shown in FIG. 4, the interlaced heat exchanger 400 includes the first microchannel tube 402A, the second microchannel tube 402B, the third microchannel tube 402C, and the fourth microchannel tube 402D. Further, the interlaced heat exchanger 400 includes the first flat tube 404A, the second flat tube 404B, the third flat tube 404C, and the fourth flat tube 404D. In an implementation, the interlaced heat exchanger 400 further includes the first inlet header 406 and the first outlet header 408 fluidly coupled to the plurality of microchannel tubes 402A-D, and the second inlet header 414 and the second outlet header 416 fluidly coupled to the plurality of flat tubes 404A-D.

In an embodiment, the interlaced heat exchanger 400 includes the plurality of fin plates 422A-D interspersed with the plurality of microchannel tubes 402A-D and the plurality of flat tubes 404A-D. As shown in FIG. 4, the plurality of fin plates 422A-D includes four fin plates, namely, the first fin plate 422A, the second fin plate 422B, the third fin plate 422C, and the fourth fin plate 422D. The plurality of fin plates 422A-D allows the flow of air (indicated by arrow 464) across a width of the interlaced heat exchanger 400 to exchange heat with at least one of the first fluid and the second fluid. In an implementation, a predefined number of microchannel tubes of the plurality of microchannel tubes 402A-D is sandwiched between fin plates 422A-D to define a second heat exchanging set 426A-B. Further, the second heat exchanging set 426A is sandwiched between rows of flats tubes of the plurality of flat tubes 404A-D. As can be seen in FIG. 4, the second microchannel tube 402B is sandwiched between the first fin plate 422A and the second fin plate 422B to define the second heat exchanging set 426A. Further, the second heat exchanging set 428A is sandwiched between the second flat tube 404B and the third flat tube 404C. Similarly, the fourth microchannel tube 402D is sandwiched between the third fin plate 422C and the fourth fin plate 422D to define the second heat exchanging set 426B.

According to an aspect of the present disclosure, heat exchange in the interlaced heat exchanger 400 provided in FIG. 4 is between the refrigerant and the air or the refrigerant and the water (or any heat transfer fluid). In an implementation, when the heat exchange occurs between the refrigerant and the water, the flow of air is turned off, and when the heat exchange occurs between the refrigerant and the air, the water flow is turned off. Further, according to some embodiments, the interlaced heat exchanger 400 can be used for applications including combined air and water system condenser where the water could be heated when there is a demand for water heating, and if the water has reached the target temperature and heat cannot be further rejected to water, the heat can be rejected to ambient air in order to be able to maintain the refrigeration system operation. Further, according to various aspects of the present disclosure, the water (or any heat transfer fluid) and the air can exchange heat with any other fluid in case the interlaced heat exchanger 400 is used in a different application, i.e., other than in refrigeration systems.

Figure 5:
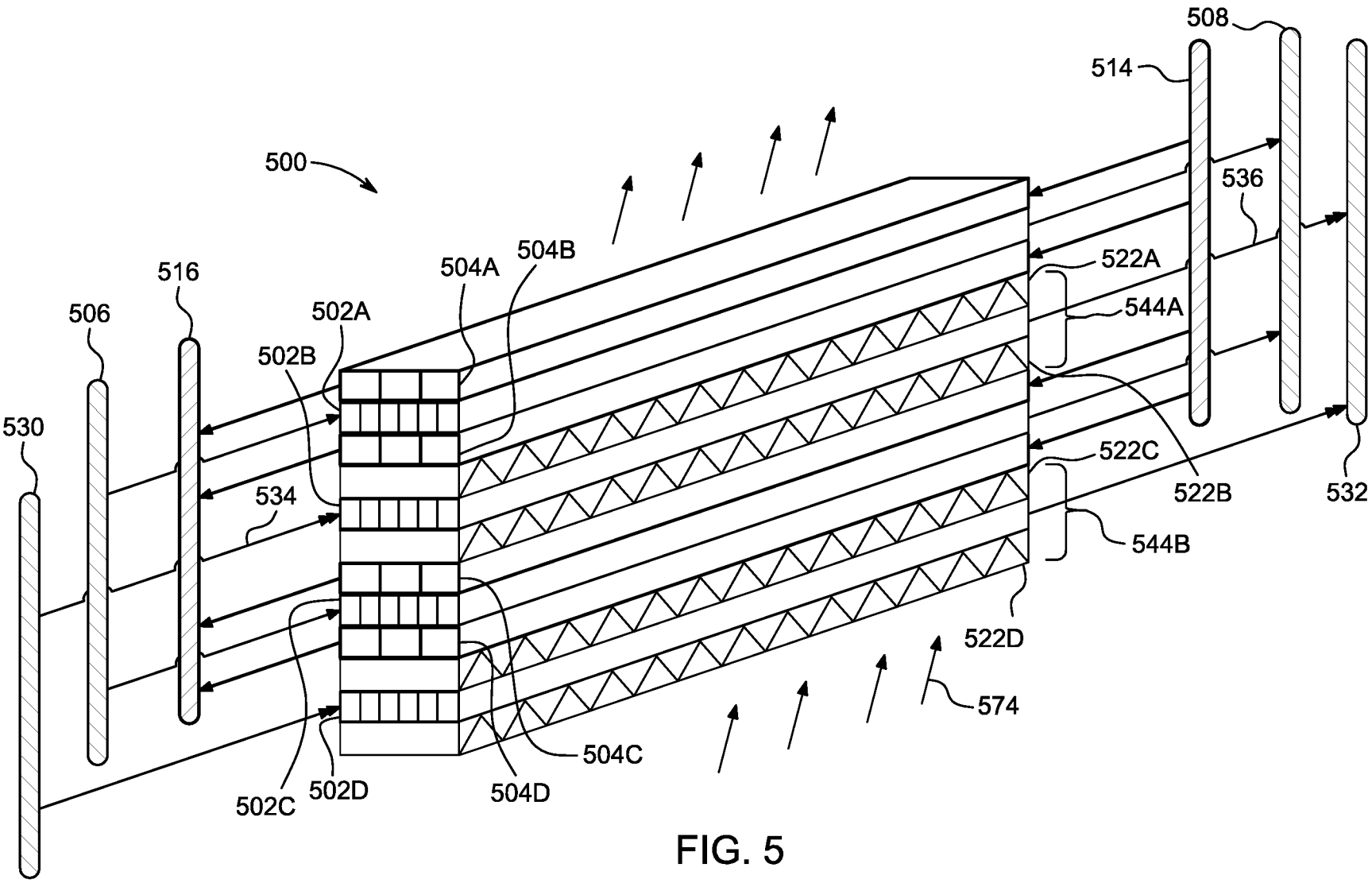
FIG. 5 is a schematic diagram of the interlaced heat exchanger, according to yet another embodiment of the present disclosure.

FIG. 5 is a schematic diagram of the interlaced heat exchanger 500, according to yet another embodiment of the present disclosure. The interlaced heat exchanger 500 may corresponds to the interlaced heat exchanger 102 of FIG. 1.

According to an embodiment, the interlaced heat exchanger 500 includes the plurality of microchannel tubes 502A-D and the plurality of flat tubes 504A-D. The plurality of microchannel tubes 502A-D is configured to allow flow of the first fluid (for example, refrigerant) therethrough and the plurality of flat tubes 504A-D is configured to allow flow of the second fluid (for example, water or any heat transfer fluid) therethrough to exchange heat with the first fluid. The flow of first fluid and the second fluid of FIG. 5 are substantially similar to that of FIG. 2. As shown in FIG. 5, the interlaced heat exchanger 500 includes the first microchannel tube 502A, the second microchannel tube 502B, the third microchannel tube 502C, and the fourth microchannel tube 502D. Further, the interlaced heat exchanger 500 includes the first flat tube 504A, the second flat tube 504B, the third flat tube 504C, and the fourth flat tube 504D. In an implementation, the interlaced heat exchanger 500 further includes the first inlet header 506 and the first outlet header 508 fluidly coupled to the plurality of microchannel tubes 502A-D, and the second inlet header 514 and the second outlet header 516 fluidly coupled to the plurality of flat tubes 504A-D.

According to an embodiment, the interlaced heat exchanger 500 further includes a third inlet header 530 and a third outlet header 532 fluidly coupled to the second microchannel tube 502B and the fourth microchannel tubes 502D of the plurality of microchannel tubes 502A-D. The third inlet header 530 is configured to supply a third fluid into the second microchannel tube 502B and the third microchannel tubes 502D of the plurality of microchannel tubes 502A-D, as indicated by arrow 534. Further, the third outlet header 532 is configured to receive the third fluid from the second microchannel tube 502B and the third microchannel tubes 502D of the plurality of microchannel tubes 502A-D, as indicated by arrow 536. In an implementation, the third inlet header 530 is configured to supply the third fluid to the second microchannel tube 502B and the third microchannel tubes 502D of the plurality of microchannel tubes 502A-D in an alternating arrangement with respect to the first inlet header 506. Further, in an implementation, the first inlet header 506 is configured to supply the first fluid to a first subset of the plurality of microchannel tubes 502A-D located in a first portion of the interlaced heat exchanger 500 and the third inlet header 530 is configured to supply the first fluid to a second subset of the plurality of microchannel tubes 502A-D located in a second portion of the interlaced heat exchanger 500. The first subset of the plurality of microchannel tubes 502A-D includes the first microchannel tube 502A and the third microchannel tube 502C, and the second subset of the plurality of microchannel tubes 502 includes the second microchannel tube 502B and the fourth microchannel tube 502D.

In an embodiment, the interlaced heat exchanger 500 includes the plurality of fin plates 522A-D. As shown in FIG. 5, the plurality of fin plates 522 includes four fin plates, namely, the first fin plate 522A, the second fin plate 522B, the third fin plate 522C, and the fourth fin plate 522D. The plurality of fin plates 522A-D allows a flow of air (indicated by arrow 574) across a width of the interlaced heat exchanger 500 to exchange heat with at least one of the first fluid and the second fluid. In an implementation, a predefined number of microchannel tubes of the plurality of microchannel tubes 502A-D is sandwiched between rows of flat tubes of the plurality of flat tubes 504A-D to define a third heat exchanging set 544A-B. Further, the third heat exchanging set 544A-B is sandwiched between two fin plates. As can be seen in FIG. 5, the second microchannel tube 502B is sandwiched between the first fin plate 522A and the second fin plate 522B to define the third heat exchanging set 544A. Further, the third heat exchanging set 544A is sandwiched between the second flat tube 504B and the third flat tube 504C. As can be seen in FIG. 5, the third microchannel tube 502C is sandwiched between the third flat tube 504C and the fourth flat tube 504D to define the third heat exchanging set 544B. Further, the third heat exchanging set 544B is sandwiched between the second fin plate 522B and the third fin plate 522C.

According to an aspect of the present disclosure, the interlaced heat exchanger 500 provided in FIG. 5 includes two separate refrigeration circuits, namely a first refrigeration circuit and a second refrigeration circuit. The first refrigeration circuit exchanges heat exclusively with air and the second refrigeration circuit exchanges heat exclusively with water or any heat transfer fluid. In an implementation, refrigerant flow is then restricted to the refrigeration circuit that exchanges heat with the active medium. In an implementation, one of the first refrigeration circuit and the second refrigeration circuit may be active at any given time. Further, in an implementation, the interlaced heat exchanger 500 can be used as air and water system condensers, where the interlaced heat exchanger 500 can be used for heat rejection to heat water or reject heat to the ambient air. Although, it has been described in FIGS. 1-5 that the first fluid and the second fluid are in counterflow arrangement, in some embodiments, the first fluid and the second fluid can be arranged to be in a parallel flow arrangement.

According to aspects of the present disclosure, the interlaced heat exchanger 500 can be used for heat exchange between any two (or more) fluids. In an example, the interlaced heat exchanger 500 allows heat exchange between refrigerant and water, refrigerant and air, and water and air.

Thus, the interlaced heat exchanger 500 can be used for both condenser and evaporator applications. Further, the interlaced heat exchanger 500 can be insulated to prevent heat loss through exposed sides of the interlaced heat exchanger 500. In an embodiment, the interlaced heat exchanger 500 allows to control and optimize the amount of water and air and achieve greater energy efficiency. Accordingly, the efficiency of the air-water system may be significantly improved.

Figure 6:
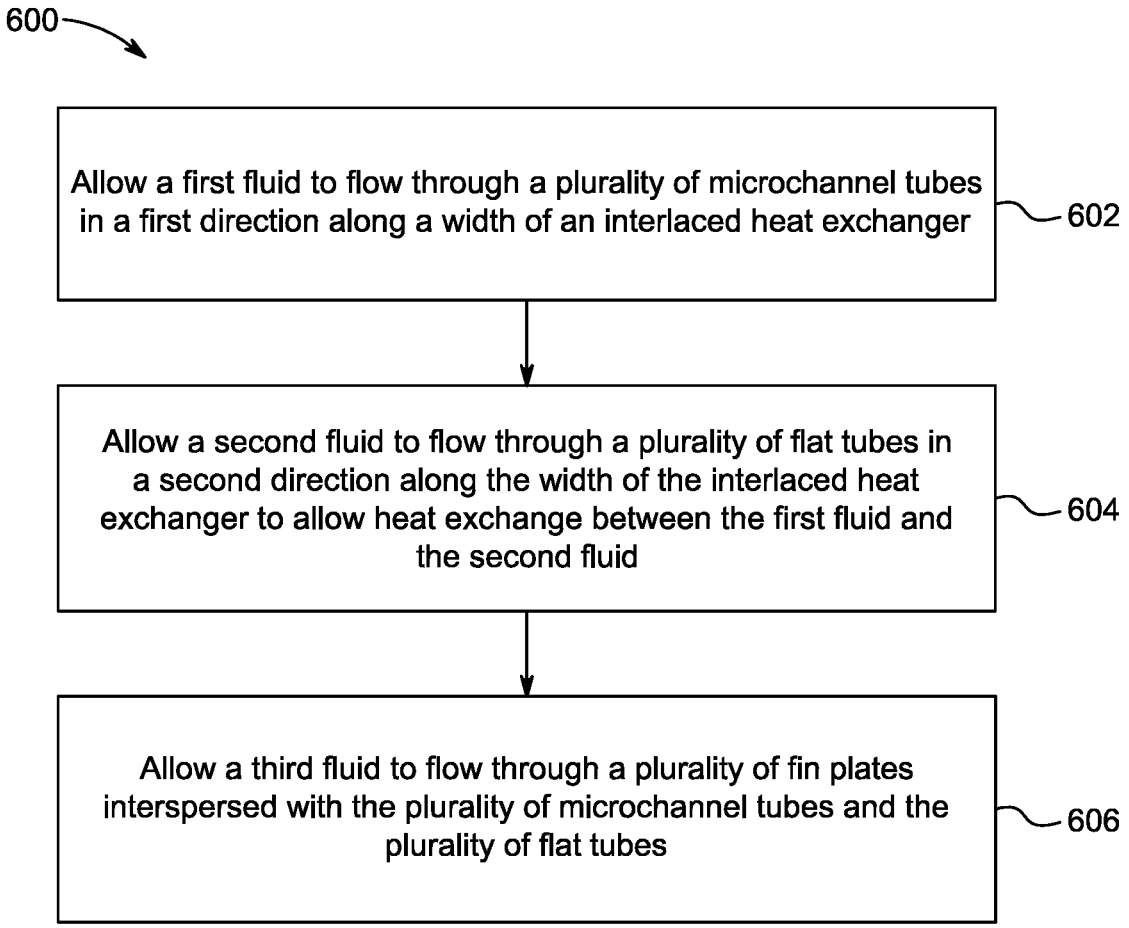
FIG. 6 is a schematic flow diagram of a method of exchanging heat between two or more fluids in the interlaced heat exchanger, according to an embodiment of the present disclosure.

FIG. 6 is a schematic flow diagram of a method 600 of exchanging heat between two or more fluids in the interlaced heat exchanger 102, according to an embodiment of the present disclosure.

At step 602, the method 600 includes allowing a first fluid to flow through the plurality of microchannel tubes 202 in a first direction along a width of the interlaced heat exchanger 102. In an implementation, the first direction of the first fluid is opposite to the second direction of the second fluid. In an example, the first fluid is a refrigerant.

At step 604, the method 600 includes allowing a second fluid to flow through the plurality of flat tubes 204 in a second direction along the width of the interlaced heat exchanger 102 to allow heat exchange between the first fluid and the second fluid. In an implementation, the plurality of microchannel tubes 202 and the plurality of flat tubes 204 are stacked in an alternating arrangement along a longitudinal axis of the interlaced heat exchanger 102 such that the plurality of microchannel tubes 202 and the plurality of flat tubes 204 are interlaced. In an example, the second fluid is one of water and a refrigerant.

At step 606, the method 600 includes allowing a third fluid to flow through the plurality of fin plates 222 interspersed with the plurality of microchannel tubes 202 and the plurality of flat tubes 204. In an example, the third fluid is air. In an implementation, the third fluid flows in a direction across the width of the interlaced heat exchanger 102 to exchange heat with at least one of the first fluid and the second fluid.

While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof.

What is claimed is:

1. An interlaced heat exchanger comprising:

a plurality of microchannel tubes configured to allow flow of a first fluid therethrough;

a plurality of flat tubes configured to allow flow of a second fluid therethrough to exchange heat with the first fluid, wherein the plurality of flat tubes is devoid of microchannels, and wherein the plurality of microchannel tubes and the plurality of flat tubes are stacked in an alternating arrangement along a longitudinal axis of the interlaced heat exchanger such that the plurality of microchannel tubes and the plurality of flat tubes are interlaced; and a plurality of fin plates interspersed with the plurality of microchannel tubes and the plurality of flat tubes, wherein the plurality of fin plates allows flow of air across a width of the interlaced heat exchanger to exchange heat with at least one of the first fluid and the second fluid.

2. The interlaced heat exchanger as claimed in claim 1, further comprising:

a first inlet header and a first outlet header fluidly coupled to the plurality of microchannel tubes, wherein the first inlet header is configured to supply the first fluid into the plurality of microchannel tubes and the first outlet header is configured to receive the first fluid from the plurality of microchannel tubes; and a second inlet header and a second outlet header fluidly coupled to the plurality of flat tubes, wherein the second inlet header is configured to supply the second fluid into the plurality of flat tubes and the second outlet header is configured to receive the second fluid from the plurality of flat tubes.

3. The interlaced heat exchanger as claimed in claim 1, wherein the first fluid flows through the plurality of microchannel tubes in a first direction and the second fluid flows through the plurality of flat tubes in a second direction, and wherein the first direction is opposite to the second direction.

4. The interlaced heat exchanger as claimed in claim 1, wherein the first fluid is a refrigerant.

5. The interlaced heat exchanger as claimed in claim 1, wherein the second fluid is water.

6. The interlaced heat exchanger as claimed in claim 1, wherein the plurality of fin plates is alternatively interspersed with the plurality of microchannel tubes and the plurality of flat tubes.

7. The interlaced heat exchanger as claimed in claim 1, wherein each fin plate of the plurality of fin plates extends along the width of the interlaced heat exchanger.

8. The interlaced heat exchanger as claimed in claim 2, further comprising a third inlet header and a third outlet header fluidly coupled to the plurality of microchannel tubes, wherein the third inlet header is configured to supply the first fluid into the plurality of microchannel tubes and the third outlet header is configured to receive the first fluid from the plurality of microchannel tubes.

9. The interlaced heat exchanger as claimed in claim 8, wherein the third inlet header is configured to supply the first fluid into the plurality of microchannel tubes in an alternating arrangement with respect to the first inlet header.

10. The interlaced heat exchanger as claimed in claim 2, wherein the first inlet header is configured to supply the first fluid to a first subset of the plurality of microchannel tubes located in a first portion of the interlaced heat exchanger and the second inlet header is configured to supply the first fluid to a second subset of the plurality of microchannel tubes located in a second portion of the interlaced heat exchanger.

11. The interlaced heat exchanger as claimed in claim 1, wherein a predefined number of flat tubes of the plurality of flat tubes is sandwiched between rows of microchannel tubes of the plurality of microchannel tubes to define a first heat exchanging set, wherein the first heat exchanging set is sandwiched between two fin plates.

12. The interlaced heat exchanger as claimed in claim 1, wherein a predefined number of microchannel tubes of the plurality of microchannel tubes is sandwiched between two fin plates to define a second heat exchanging set, and wherein the second heat exchanging set is sandwiched between rows of flats tubes of the plurality of flat tubes.

13. The interlaced heat exchanger as claimed in claim 1, wherein a predefined number of microchannel tubes of the plurality of microchannel tubes is sandwiched between rows of flat tubes of the plurality of flat tubes to define a third heat exchanging set, and wherein the third heat exchanging set is sandwiched between two fin plates.

14. An interlaced heat exchanger comprising:

a plurality of microchannel tubes configured to allow flow of a first fluid therethrough; and a plurality of flat tubes configured to allow flow of a second fluid therethrough to exchange heat with the first fluid, wherein the plurality of flat tubes is devoid of microchannels, and wherein the plurality of microchannel tubes and the plurality of flat tubes are stacked in an alternating arrangement along a longitudinal axis of the interlaced heat exchanger such that the plurality of microchannel tubes and the plurality of flat tubes are interlaced.

15. The interlaced heat exchanger as claimed in claim 14, wherein a number of flat tubes of the plurality of flat tubes is less than a number of microchannels defined in each microchannel tube of the plurality of microchannel tubes.

16. The interlaced heat exchanger of claim 1, wherein the plurality of microchannel tubes comprises a first microchannel tube and a second microchannel tube, the plurality of flat tubes comprises a first flat tube and a second flat tube, and the plurality of fin plates comprises a first fin plate;

wherein the first fin plate is disposed between the first microchannel tube and the second microchannel tube, and wherein the first flat tube and the second flat tube are separated by the first microchannel tube, the first fin plate, and the second microchannel tube.

* * * * *